US009194673B1

(12) United States Patent
Lee

(10) Patent No.: US 9,194,673 B1
(45) Date of Patent: Nov. 24, 2015

(54) ARROWHEAD

(71) Applicant: Youngki Lee, Busan (KR)

(72) Inventor: Youngki Lee, Busan (KR)

(73) Assignee: Youngki Lee, Busan (KR)

( * ) Notice: Subject to any disclaimer, the term of this patent is extended or adjusted under 35 U.S.C. 154(b) by 0 days.

(21) Appl. No.: 14/591,776

(22) Filed: Jan. 7, 2015

(51) Int. Cl.
*F42B 6/08* (2006.01)
*F42B 12/34* (2006.01)

(52) U.S. Cl.
CPC .. *F42B 6/08* (2013.01); *F42B 12/34* (2013.01)

(58) Field of Classification Search
CPC ..... F42B 6/08
See application file for complete search history.

(56) References Cited

U.S. PATENT DOCUMENTS 4,973,060 A 11/1990 Herzing
5,066,021 A 11/1991 DeLucia
5,082,292 A 1/1992 Puckett et al.
6,200,237 B1 3/2001 Barrie
6,258,000 B1 7/2001 Liechty, II
6,287,223 B1 9/2001 Liechty, II
6,669,586 B2 12/2003 Barrie et al.
8,062,155 B2 11/2011 Butcher
8,894,519 B2 * 11/2014 Young ..... F24B 6/08 473/583

* cited by examiner

*Primary Examiner* — John Ricci
(74) *Attorney, Agent, or Firm* — The PL Law Group, PLLC

(57) ABSTRACT

The present invention relates to an arrowhead, and more particularly, to an arrowhead which enables a plurality of expanding blades to unfold rapidly and reliably, and prevents the expanding blades from folding again inside a target after the expanding blades penetrate the target, and an arrow. According to embodiments of the present invention, since the plurality of expanding blades are adapted to unfold upon entering a target at the same at which the target is hit, the plurality of expanding blades penetrates the target in an unfolded state, and thus it is possible to induce excessive bleeding in game serving as the target, because the expanding blades are prevented from folding again after the expanding blades penetrate the target.

9 Claims, 10 Drawing Sheets

ARROWHEAD

BACKGROUND

1. Field of the Invention

The present invention relates to an arrowhead and an arrow, and more particularly, to an arrowhead having expanding blades.

2. Discussion of Related Art

In general, an arrow includes an arrow shaft made of a hollow pipe body, an arrowhead installed at a front end of the arrow shaft, an arrow notch for fitting the arrow on a bowstring, and arrow feathers for securing flight stability of the arrow.

Among these, the arrowhead serves to substantially penetrate a target. Since energy accumulated in the arrow is concentrated on the arrowhead at a moment at which the arrow hits its target, the arrow should have excellent wear resistance and strength and should also have a structure enabling the arrow to fly stably.

Generally, the arrow has a sharpened upper end in order to provide great penetration power. However, an arrowhead having excellent penetration power may not be suitable for particular hunting purposes. This is because sharp arrowheads may not deliver a deadly wound to larger game and thus it is difficult to quickly subdue the game. Therefore, in view of this point, 2 to 4 sharp blades may be provided at an edge of a sharp arrowhead. Alternatively, a broadhead for inducing severe bleeding may be used.

Meanwhile, since the blades provided at an edge of the broadhead of the arrowhead may affect the flight stability of the arrow, various kinds of arrowheads having a structure in which the blades may normally fold inward and then unfold upon hitting a target are already well known.

A blade having such an unfoldable structure is called an expanding blade. Such expanding blades are disclosed in many patent documents, such as U.S. Pat. No. 5,082,292 entitled "BROADHEAD WITH DEPLOYABLE CUTTING BLADES," U.S. Pat. No. 5,066,021 entitled "ARROW SYSTEM," U.S. Pat. No. 4,973,060 entitled "ARROWHEAD WITH EXPANDABLE BLADES," U.S. Pat. No. 6,669,586 entitled "EXPANDING BROADHEAD," U.S. Pat. No. 6,258,000 entitled "PENETRATION ENHANCING AERODYNAMICALLY FAVORABLE ARROWHEAD," U.S. Pat. No. 6,287,223 entitled "DULLING PREVENTION FOR SHARP CUTTING EDGE OF BLADE-OPENING ARROWHEAD BLADES WHEN IN A CLOSED IN-FLIGHT POSITION," U.S. Pat. No. 8,062,155 entitled "ARROWHEAD HAVING BOTH FIXED AND MECHANICALLY EXPANDABLE BLADES," and U.S. Pat. No. 6,200,237 entitled "SLIDING BODY EXPANDING BROADHEAD."

In all of these patent documents, 2 to 4 expanding blades are provided. When the arrow hits a target such as game, the multiple expanding blades unfold in order to dig up a wounded area of the game, penetrate more deeply, and thereby increase killing power.

However, in the conventional expanding blades, there is a disadvantage in that, after the arrow is shot, the expanding blades unfold by themselves during flight and thus have a bad effect on flight stability, accuracy rate, and a flight distance of the arrow.

Further, after the arrow hits its target, the expanding blades may abnormally fold due to movement of the target or the like, and thus the bleeding may not be induced any longer.

Therefore, it is necessary to develop a new arrowhead having a structure in which the folded expanding blades do not unfold by themselves during flight of the arrow and thus the arrow may fly stably, and the expanding blades automatically unfold only when the arrow hits its target, and are also maintained in the unfolded state after the arrow hits its target.

SUMMARY

The present invention is directed to provide an arrowhead including a structure in which the folded expanding blades do not unfold by themselves during flight of the arrow and thus the arrow may fly stably, and the expanding blades automatically unfold only when the arrow hits its target, and are also maintained in the unfolded state after the arrow hits its target.

According to an aspect of the present invention, there is provided an arrowhead including a penetration tip having a sharpened upper end; a first body including a body portion having a hollow portion therein and one or more expanding blade guide grooves formed in an outer surface of the body portion; an impact delivery rod connected with the penetration tip to be movable in a lengthwise direction of the first body in the hollow portion by an impact applied to the penetration tip; a cylinder being interlocked with the impact delivery rod and movable in the lengthwise direction of the first body in the hollow portion; an expanding blade rotatably disposed in the expanding blade guide groove to expand from the first body due to the impact delivered from the impact delivery rod; and a second body coupled with the first body and having a screw portion coupled with an arrow shaft, wherein the impact delivery rod includes a contact surface configured to deliver the impact to the expanding blade, and the expanding blade has a groove portion capable of being coupled with an edge of the cylinder.

A blade may be formed at one side of the expanding blade, and the groove portion may be formed at a lower end of the blade.

A spur configured to prevent the expanding blade from rotating above a predetermined angle may be formed at the other side of the expanding blade.

The arrowhead may further include a return restriction portion provided between the spur and the groove portion of the expanding blade to prevent the expanding blade from returning into the first body after the expanding blade expands.

The arrowhead may further include an elastic member disposed between the cylinder and the second body to elastically support the cylinder.

A groove configured to accommodate the elastic member therein may be formed in a lower side of the cylinder.

A protruding portion inserted into the penetration tip may be formed at an upper end of the first body, and the protruding portion may be slidable in the penetration tip.

The contact surface may be located on a lower side of a restriction member, the restriction member restricting movement of the impact delivery rod in the hollow portion.

A coupling hole may be formed in the expanding blade, a rotating shaft may be inserted into the coupling hole, and the expanding blade may be rotatable about the rotating shaft.

BRIEF DESCRIPTION OF THE DRAWINGS

The above and other objects, features, and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Various embodiments of the present invention will be described herein below with reference to the accompanying drawings. However, these are merely exemplary embodiments, and the present invention is not limited thereto.

In the following description, detailed descriptions of well-known functions or constructions will be omitted when they are judged to obscure the invention with unnecessary details. Also, the terms used herein are defined according to the functions of the present invention. Thus, the terms may vary depending on a user's or operator's intentions or practices. Therefore, the terms used herein must be understood based on the descriptions made herein.

Figure 1:
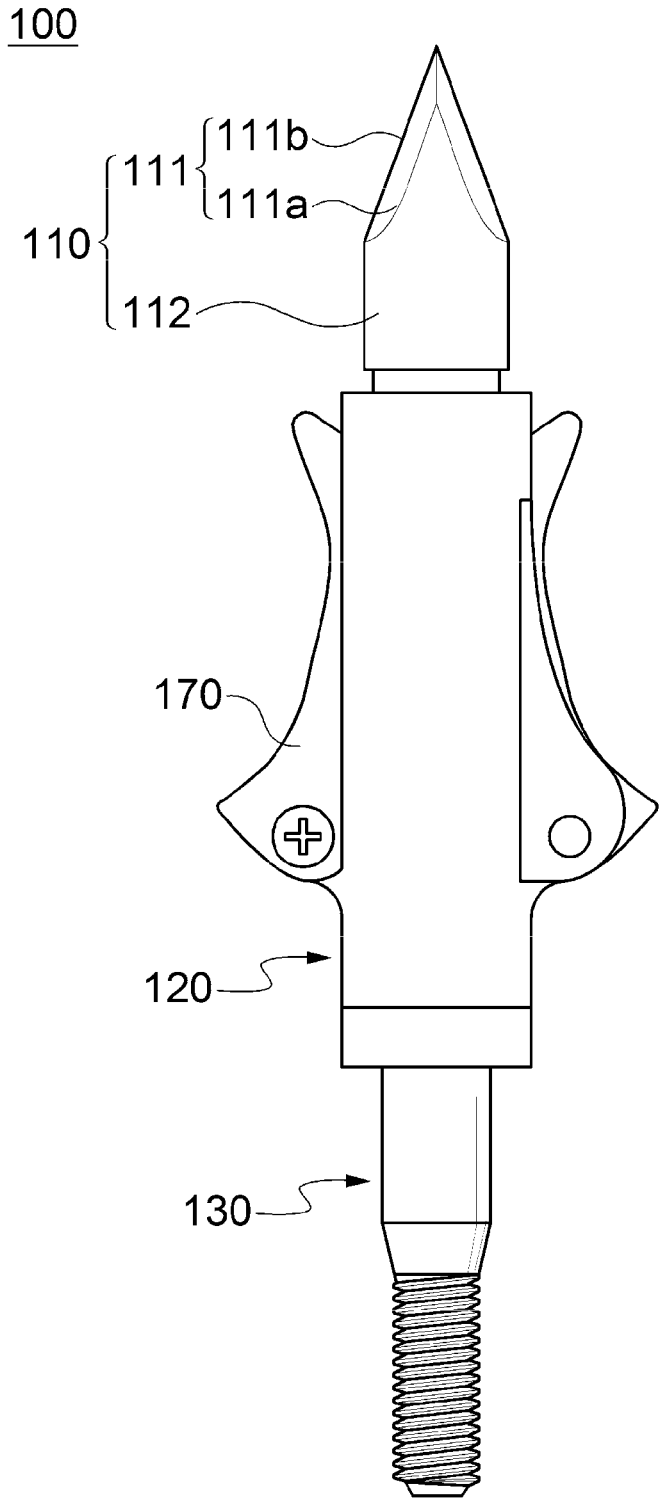
FIG. 1 is a front view of an arrowhead according to one embodiment of the present invention.
Figure 2:
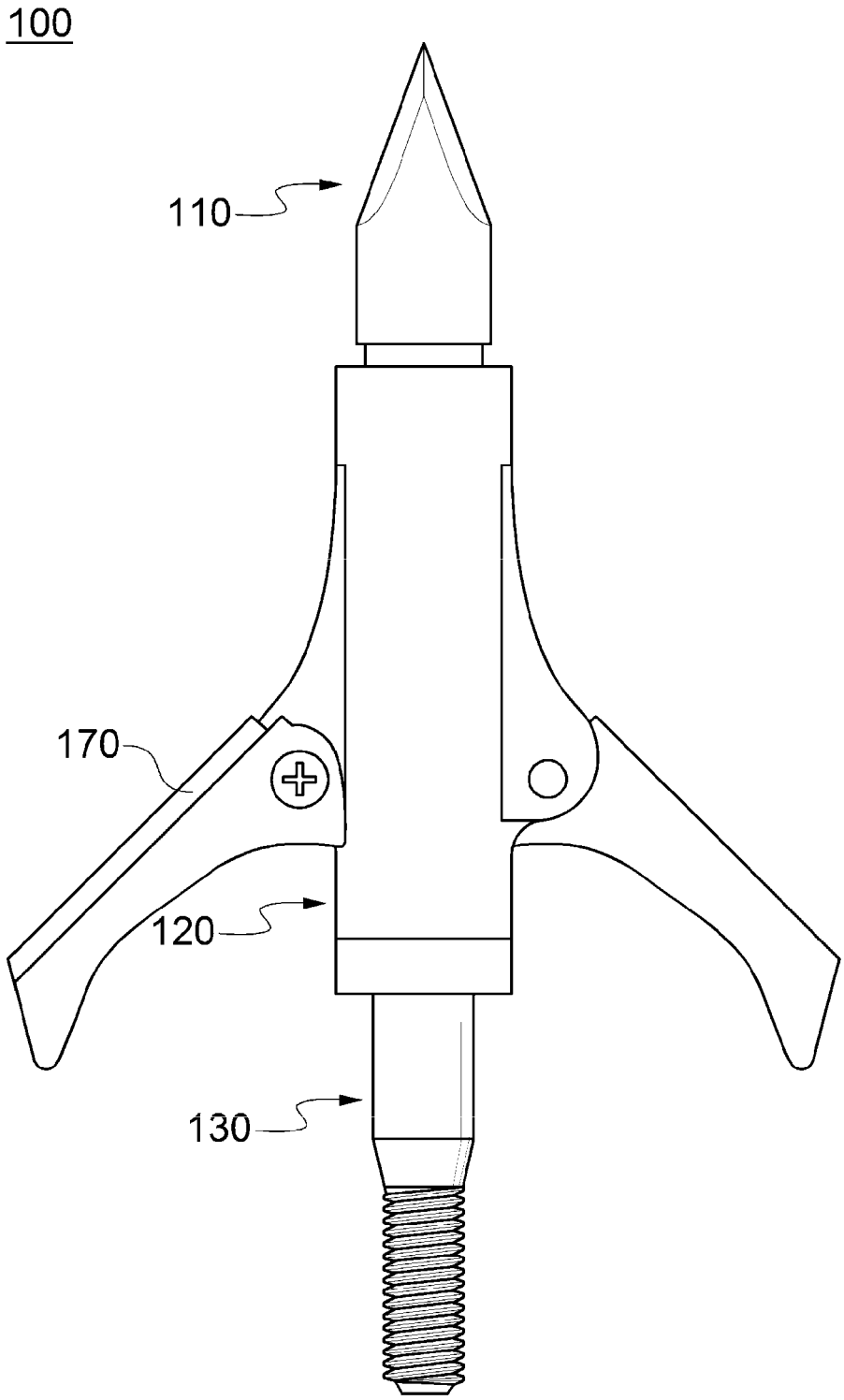
FIG. 2 is a front view of the arrowhead according to one embodiment of the present invention in which expanding blades are unfolded.
Figure 3:
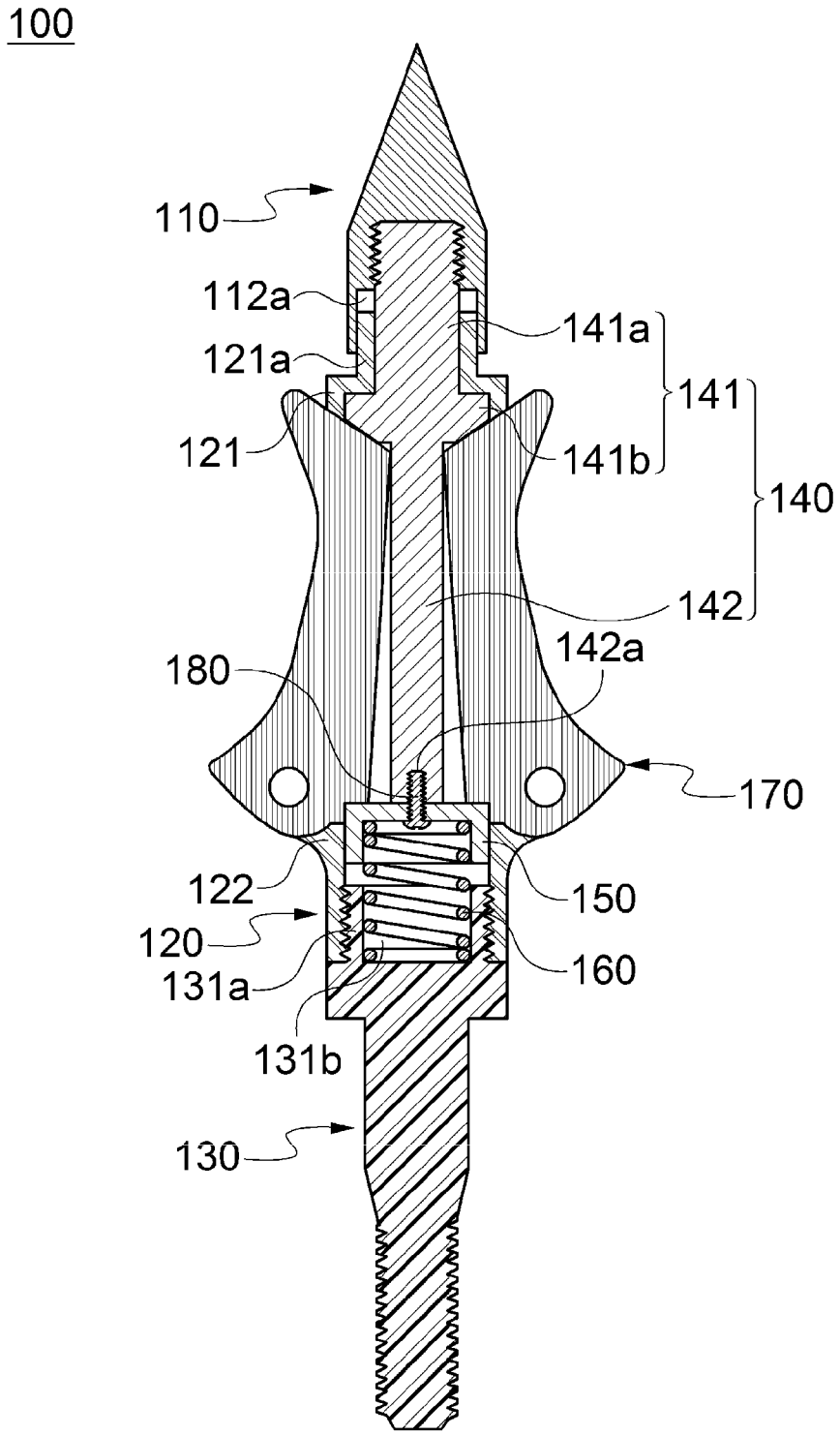
FIG. 3 is an internal cross-sectional view of the arrowhead according to one embodiment of the present invention.
Figure 4:
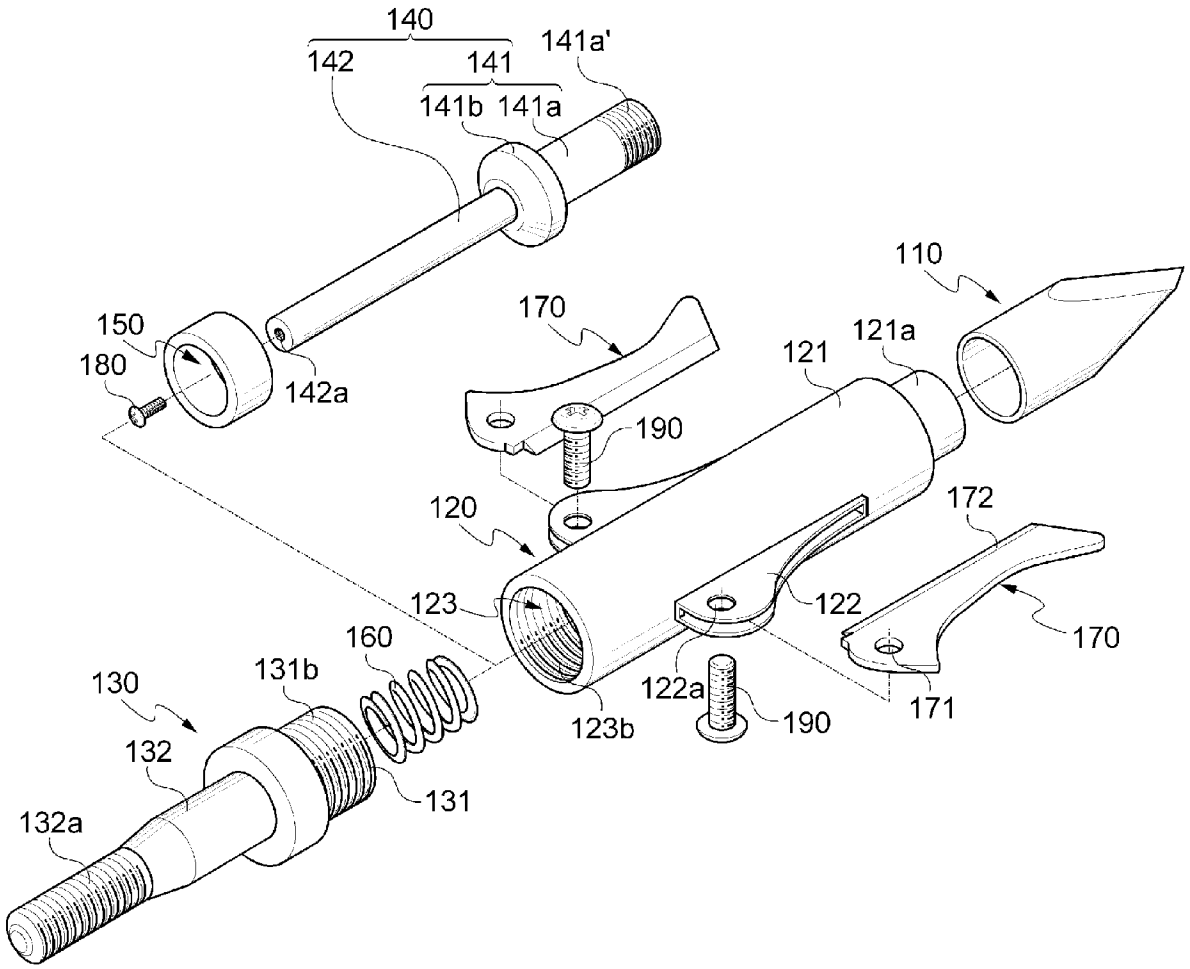
FIG. 4 is an exploded perspective view of the arrowhead according to one embodiment of the present invention.

FIG. 1 is a front view of an arrowhead 100 according to one embodiment of the present invention, FIG. 2 is a front view of the arrowhead 100 according to one embodiment of the present invention in which expanding blades are unfolded, FIG. 3 is an internal cross-sectional view of the arrowhead 100 according to one embodiment of the present invention, and FIG. 4 is an exploded perspective view of the arrowhead 100 according to one embodiment of the present invention.

As illustrated in FIGS. 1 to 4, an arrowhead 100 according to a first embodiment of the present invention includes a penetration tip 110, a first body 120, a second body 130, an impact delivery rod 140, and expanding blades 170.

The penetration tip 110 serves to firstly penetrate a target when an arrow hits the target, and thus is formed to have a sharpened upper end. Here, the target may be, for example, game such as an animal or the like. For example, the penetration tip 110 may be formed so that the upper end thereof is sharpened and a diameter thereof is gradually increased toward a lower end thereof and then maintained uniformly. The penetration tip 110 may include a tip portion 111 formed at the upper end thereof and a body portion 112 formed at the lower end thereof.

The tip portion 111 may include a flat tip surface 111*a* and a tip edge 111*b* which is a sharp edge. Since the tip surface 111*a* and the tip edge 111*b* are formed at the tip portion 111, it is possible to additionally secure a pointed portion (or a sharp portion) at the tip portion 111 which penetrates the target. Therefore, when the penetration tip 110 penetrates the target, it is possible to effectively and easily penetrate the target and also induce excessive bleeding in the target. Here, in the drawing, two tip surfaces 111*a* are provided at the tip portion 111. However, the number of tip surfaces 111*a* is not limited thereto, and three or four or more tip surfaces 111*a* may be provided at the tip portion 111.

The body portion 112 may have a hollow cylindrical shape, and may be formed to have a uniform diameter and to extend downward. However, a shape of the body portion 112 is not limited thereto, and the body portion 112 may be formed to have a diameter that gradually increases toward a lower side thereof, and the tip surface and the tip edge may be formed to an outer circumferential surface of the body portion 112, like the tip portion 111. The body portion 112 may include a hollow portion 112*a* formed therein, and a screw thread (not shown) formed on an upper inner circumferential surface of the body portion 112. Forming of the screw thread may serve to couple the impact delivery rod 140 and the penetration tip 110. A coupling manner of the impact delivery rod 140 and the penetration tip 110 may be the same as that of a cylindrical member 141*a* of an upper portion 141 of the impact delivery rod 140 and the screw thread formed on the inner circumferential surface of the body portion 112 according to the forming of such a screw thread, which will be described later, but is not limited thereto. For example, the hollow portion may be formed at the upper side of the body portion 112 to have a polygonal shape, the upper portion 141 of the impact delivery rod 140 may be formed to have a corresponding shape, and the upper portion 141 may be inserted into the hollow portion of the body portion 112 and then fastened thereto by a separate fastening means (a groove-protrusion coupling).

The first body 120 forming a body of the arrowhead 100 includes a body portion 121 having a hollow portion 123 defined therein and also having the impact delivery rod 140, the cylinder 150, an elastic member 160 and the expanding blades 170 disposed therein, and the body portion 121 having a plurality of expanding blade guide grooves 122 formed in an outer surface thereof. The plurality of expanding blade guide grooves 122 may be formed to extend in a lengthwise direction of the first body 120. Also, the plurality of expanding blade guide grooves 122 may be formed to have a length which corresponds to or is longer than that of the plurality of expanding blades 170, and the plurality of expanding blades 170 may fold inward into or unfold outward from the first body 120 through the plurality of expanding blade guide grooves 122. In a state in which the expanding blades 170 are folded, outer parts of the expanding blades 170 may partly protrude outward from the first body 120 or may be completely inserted into the first body 120. In the drawings, two expanding blade guide grooves 122 are each formed in the outer surface of the first body 120 so as to correspond to positions of the expanding blades 170 and to be spaced at regular intervals from each other. However, the number of expanding blade guide grooves 122 is not limited thereto, and three or more expanding blade guide grooves 122 may be formed in the outer surface of the first body 120. The number of expanding blade guide grooves 122 may be more than or the same as that of the expanding blades 170 to be provided.

The hollow portion 123 may be formed in the body portion 121 to extend in the lengthwise direction of the first body 120, and may have a cylindrical shape. The hollow portion 123 may receive the impact delivery rod 140, the cylinder 150 and the elastic member 160, and thus may have a larger diameter than the impact delivery rod 140, the cylinder 150 and the elastic member 160. As will be described later, the impact delivery rod 140 and the cylinder 150 may be interlocked with the penetration tip 110 in the hollow portion 123 to move up and down.

A protruding portion 121*a* inserted into the penetration tip 110 is formed at an upper end of the first body 120. The protruding portion 121*a* may have, for example, a pipe shape. The protruding portion 121*a* may be inserted into the hollow portion 112*a* of the penetration tip 110, and the protruding portion 121*a* may move linearly in the penetration tip 110 to be slidable.

The impact delivery rod 140 coupled with the penetration tip 110 may be provided in the body portion 121. As described above, the impact delivery rod 140 may be located in the hollow portion 123 of the body portion 121, and may move in the lengthwise direction of the first body 120 due to an impact generated when the penetration tip 110 collides with the target. The impact delivery rod 140 may have the upper portion 141 including a cylindrical member 141*a* and a restriction member 141*b*, and a lower portion 142 connected to the upper portion 141. At least a part of the cylindrical member 141*a* may be coupled inside the penetration tip 110. The restriction member 141*b* may restrict a movement range of the impact delivery rod 140 in the first body 120. A contact surface 141*c* located at a lower side of the restriction member 141*b* may transmit the impact generated when the penetration tip 110 collides with the target to the expanding blades 170, such that the expanding blades 170 unfold. The lower portion 142 of the impact delivery rod 140 may be coupled with the cylinder 150 so that the cylinder 150 moves along with the impact delivery rod 140.

The cylinder 150 may be fastened to the lower portion 142 of the impact delivery rod 140 by a bolt 180, and may move along with movement of the impact delivery rod 140 in the lengthwise direction of the first body 120 in the hollow portion 123 of the body portion 121. The cylinder 150 may serve to restrict or allow folding or unfolding of the expanding blades 170.

The elastic member 160 which elastically supports a lower end of the cylinder 150 may be provided in the first body 120. As described above, the elastic member 160 may be located in the hollow portion 123 of the body portion 121. For example, the elastic member 160 may be a spring. A groove 151 may be formed in a lower portion of the cylinder 150, and the elastic member 160 may be accommodated therein, and the cylinder 150 may be fastened to the lower portion 142 of the impact delivery rod 140 by the bolt 180. As will be described later, the cylinder 150 may move up and down in the lengthwise direction of the first body 120 and may be interlocked with the up and down movement of the impact delivery rod 140 to be movable. When the cylinder 150 is interlocked with the impact delivery rod 140 and moves toward the lower side of the first body 120, the cylinder 150 presses the elastic member 160, and the elastic member 160 is compressed. Meanwhile, it was described above that the cylinder 150 is provided separately from the impact delivery rod 140. However, the cylinder 150 may be integrally formed with the impact delivery rod 140.

Further, the plurality of expanding blades 170 may be hinged in the expanding blade guide grooves 122 formed in the first body 120. An insertion hole 122*a* may be formed at each of the expanding blade guide grooves 122, a coupling hole 171 may be formed in each of the expanding blades 170, and a rotating shaft 190 may be inserted into the insertion hole 122*a* and the coupling hole 171. Therefore, the expanding blades 170 may rotate about the rotating shaft 190. Downward movement of the cylinder 150 may allow the unfolding of the expanding blades 170. To this end, as will be described later, a groove portion 173 may be formed in an outer circumferential surface of a lower end side of each of the expanding blades 170, and the groove portion 173 may be coupled with an edge 154 of the cylinder 150. While the coupling between the edge 154 and the groove portion 173 is released according to the linear movement of the impact delivery rod 140 and the cylinder 150, the expanding blades 170 may fold.

A second body 130 may be coupled to a lower end of the first body 120. An upper portion 131 of the second body 130 may be coupled with the first body 120, and a lower portion 132 of the second body 130 may include a screw portion 132*a* coupled with an arrow shaft (not shown). A screw thread 131*b* may be formed at the upper portion 131 of the second body 130 to be coupled with a screw thread 123*b* formed on an lower inner side of the first body 120. An upper surface 131*a* of the upper portion 131 may restrict the downward movement of the cylinder 150.

Figure 5:
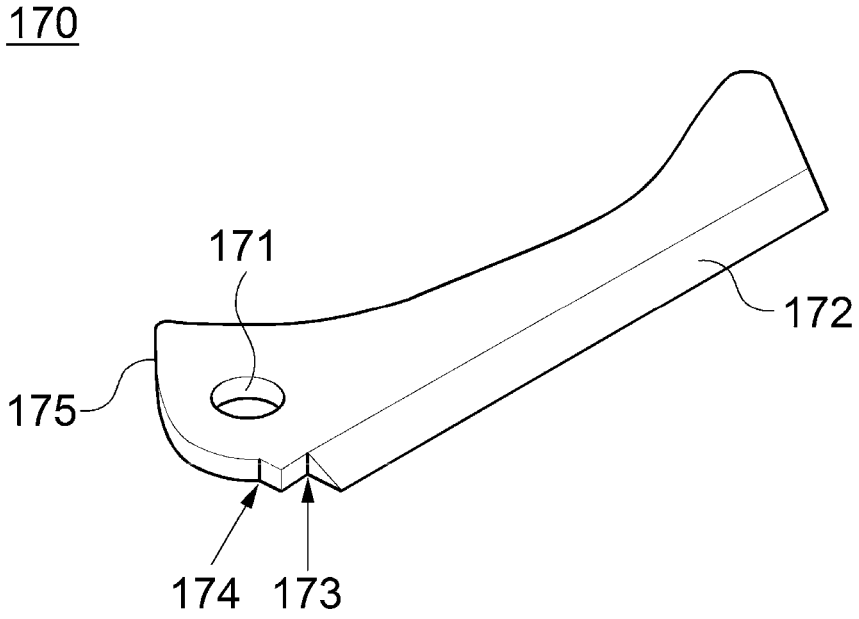
FIG. 5 is a perspective view illustrating an exterior of the expanding blades according to one embodiment of the present invention.

FIG. 5 is a perspective view illustrating an exterior of the expanding blades 170 according to one embodiment of the present invention.

As illustrated in FIG. 5, each of the expanding blades 170 includes a blade 172 formed at one side thereof, the groove portion 173 formed at a lower end of the blade 172 to be coupled with the edge 154 of the cylinder 150, a return restriction portion 174 configured to restrict the expanding blades 170 from folding again and then returning into the first body when the expanding blades 170 unfold, and a spur 175 formed at the other side of each of the expanding blades 170 to be bent or curved. The coupling hole 171 may be formed in the lower portion of each of the expanding blades 170.

When the expanding blades 170 unfold and then receive a force in a direction in which the expanding blades 170 fold again, the return restriction portion 174 is caught by the edge 154 of the cylinder 150 and thus prevents the expanding blades 170 from rotating in the direction in which the expanding blades 170 fold. The return restriction portion 174 may be formed between the groove portion 173 and the spur 175.

The spur 175 is formed to be caught by the edge 154 of the cylinder 150, thereby preventing the expanding blades 170 from excessively rotating and being bent toward the second body 130, and thus preventing the expanding blades 170 from rotating above a predetermined angle.

Figure 6:
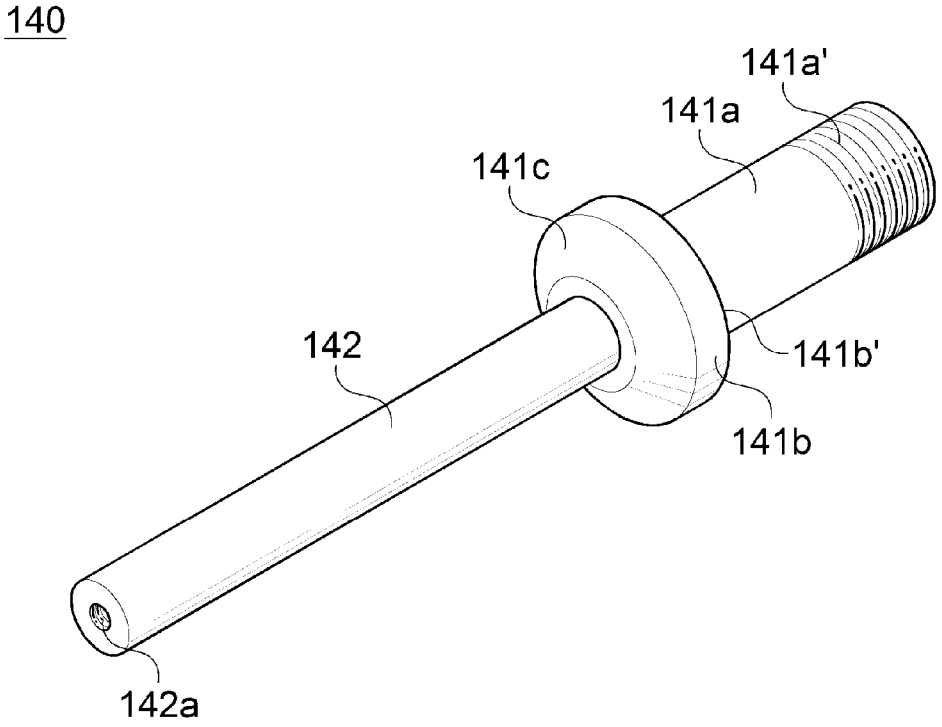
FIG. 6 is a perspective view illustrating an exterior of an impact delivery rod according to one embodiment of the present invention.

FIG. 6 is a perspective view illustrating an exterior of the impact delivery rod 140 according to one embodiment of the present invention.

As illustrated in FIG. 6, the impact delivery rod 140 may include the upper portion 141 having the cylindrical member 141*a* and the restriction member 141*b*, and the lower portion 142 connected to the upper portion 141. A screw thread 141*a*' may be formed at the cylindrical member 141*a* to be coupled with the screw thread formed inside the penetration tip 110. The restriction member 141*b* may restrict the movement range of the impact delivery rod 140 which is movable in the first body 120. The inclined contact surface 141*c* is formed at a lower portion of the restriction member 141*b*, such that a force applied to the expanding blades 170 may be formed in a direction in which the expanding blades 170 unfold when the impact delivery rod 140 moves downward in the lengthwise direction of the first body 120 due to the impact generated when the penetration tip 110 collides with the target. A bolt insertion hole 142*a* into which the bolt 180 can be inserted may be formed at the lower portion 142 of the impact delivery rod 140 in order to fasten it to the cylinder 150.

Figure 7A:
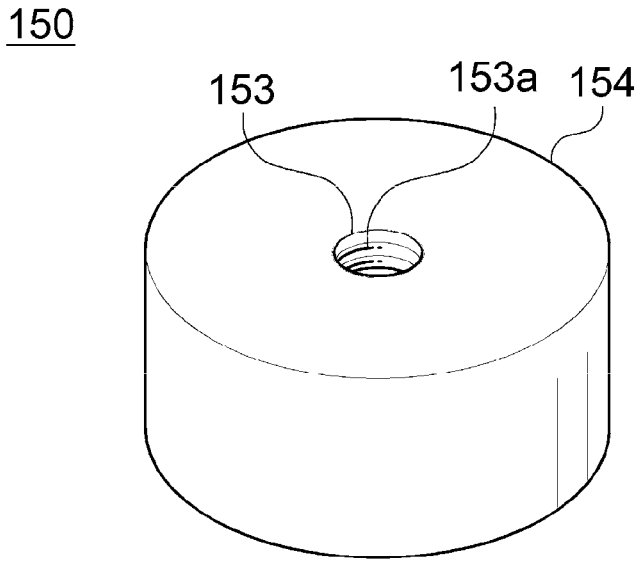
FIG. 7A is a perspective view illustrating an exterior of an upper side of a cylinder according to one embodiment of the present invention.
Figure 7B:
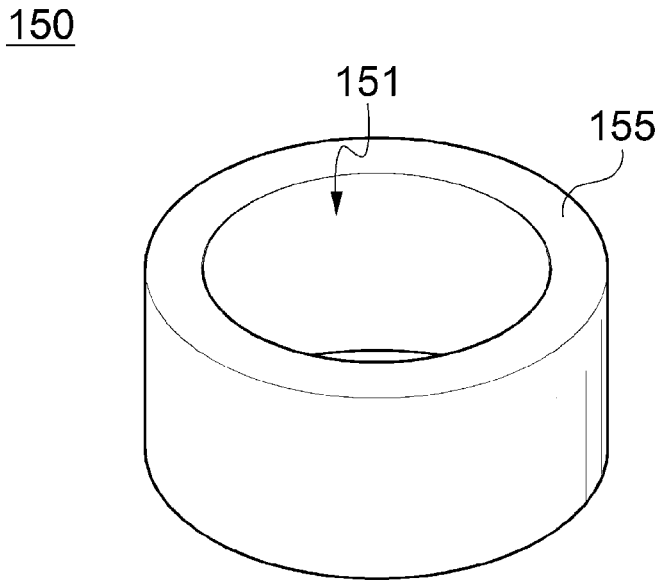
FIG. 7B is a perspective view illustrating an exterior of a lower side of the cylinder according to one embodiment of the present invention.

FIG. 7A is a perspective view illustrating an exterior of an upper side of the cylinder 150 according to one embodiment of the present invention, and FIG. 7B is a perspective view illustrating an exterior of a lower side of the cylinder 150 according to one embodiment of the present invention.

As illustrated in FIGS. 7A and 7B, the cylinder 150 may have the cylindrical shape in which the groove 151 is formed in the lower portion thereof. A bolt insertion hole 153 into which the bolt 180 can be inserted may be formed at a center portion of the cylinder 150 in order to fasten it to the lower portion 142 of the impact delivery rod 140. A screw thread 153*a* is formed at the bolt insertion hole 153 to be screw-coupled with the bolt 180. As described above, when the expanding blades 170 are folded, the edge 154 of the cylinder 150 may be coupled with the groove portion 173 of each of the expanding blade 170. Further, the up and down movement of the cylinder 150 may be restricted by a lower surface 155 of the cylinder 150 coming in contact with the upper surface 131*a* of the second body 130.

Figure 8:
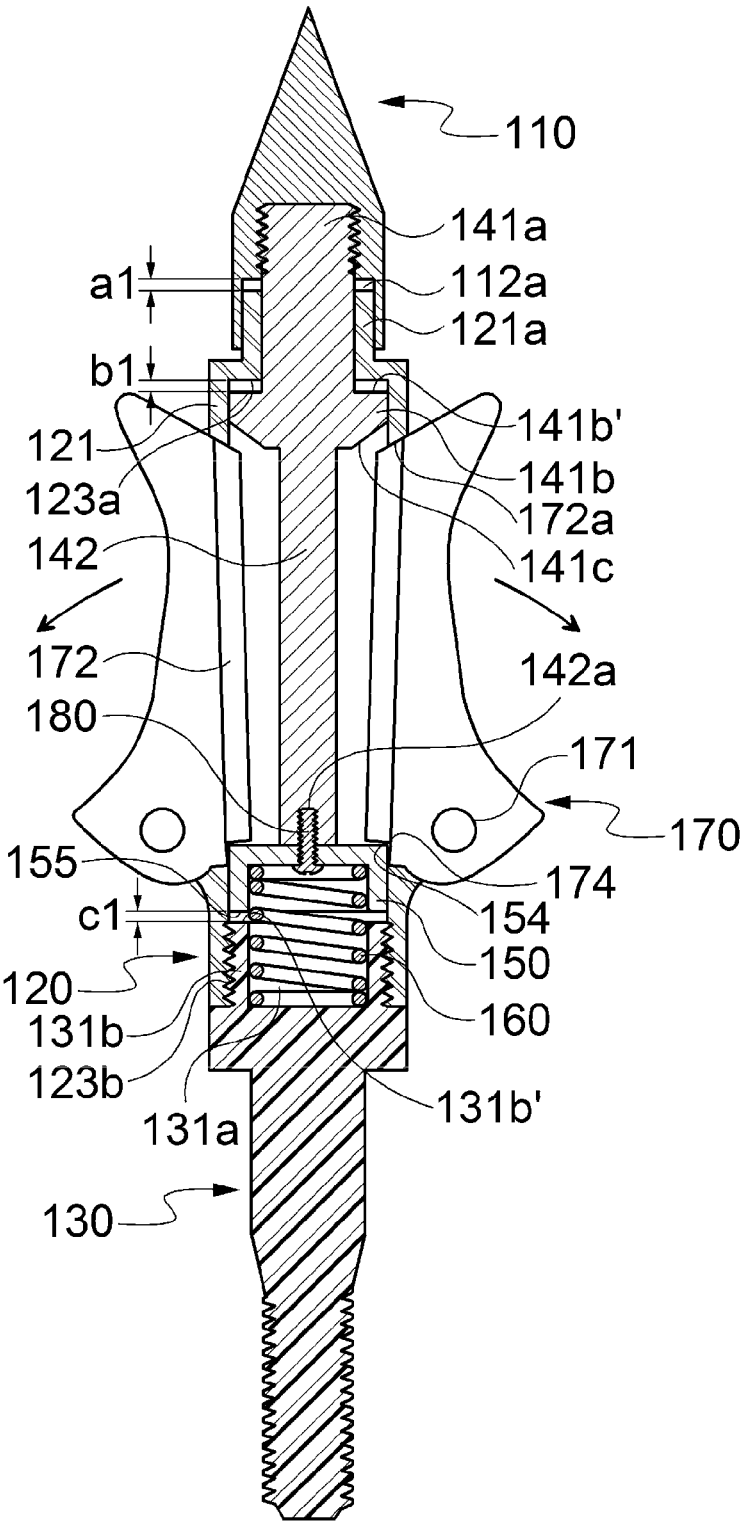
FIG. 8 is a cross-sectional view of the arrowhead when the arrowhead collides with a target in a state in which the expanding blades are folded according to one embodiment of the present invention.

FIG. 8 is a cross-sectional view of the arrowhead 100 when the arrowhead collides with a target in a state in which the expanding blades 170 are folded according to one embodiment of the present invention.

As illustrated in FIG. 8, when the plurality of expanding blades 170 are folded, the elastic member 160 is not compressed, and the groove portion 173 of each of the expanding blades 170 may be coupled with the edge 154 of the cylinder 150.

Then, if the arrow is shot and hits the target (o), the penetration tip 110 penetrates skin and flesh of game serving as the target. In this process, the penetration tip 110 may receive a pressure from the target and thus may move downward in the lengthwise direction of the first body 120. At this time, a distance a1 of the hollow portion 112*a* in the penetration tip 110 gradually reduces. Therefore, as illustrated in FIG. 8, the impact delivery rod 140 coupled with the penetration tip 110 may move along the hollow portion 123 of the first body 120 toward the lower side of the first body 120. At this time, a distance b1 between an inner upper surface 123*a* of the hollow portion 123 of the first body 120 and an upper surface 141*b* of the restriction member 141*b* of the impact delivery rod 140 gradually increases. Therefore, the contact surface 141*c* of the impact delivery rod 140 pushes the expanding blades 170. Since the contact surface 141*c* is formed to be inclined with respect to the lengthwise direction of the first body 120, a force transmitted by the impact delivery rod 140 in the lengthwise direction of the first body 120 serves as a force in a direction in which the expanding blades 170 unfold.

Further, as the impact delivery rod 140 moves toward the lower side of the first body 120, the cylinder 150 connected with the impact delivery rod 140 may also move together toward the lower side of the first body 120. As the cylinder 150 moves, the coupling between the edge 154 of the cylinder 150 and the groove portions 173 of the expanding blades 170 may be released. Therefore, rotation of the expanding blades 170, which is restricted by the coupling between the edge 154 of the cylinder 150 and the groove portions 173 of the expanding blades 170, may be freely achieved. The expanding blades 170 may rotate about a hinge axis (coupling hole) 171 due to the force transmitted by the contact surface 141*c* and the releasing of the coupling between the edge 154 and the groove portions 173.

As the cylinder 150 moves toward the lower side of the first body 120, the elastic member 160 is compressed, and a distance c1 between the lower surface 155 of the cylinder 150 and the upper surface 131*a* of the second body 130 gradually reduces.

Figure 9:
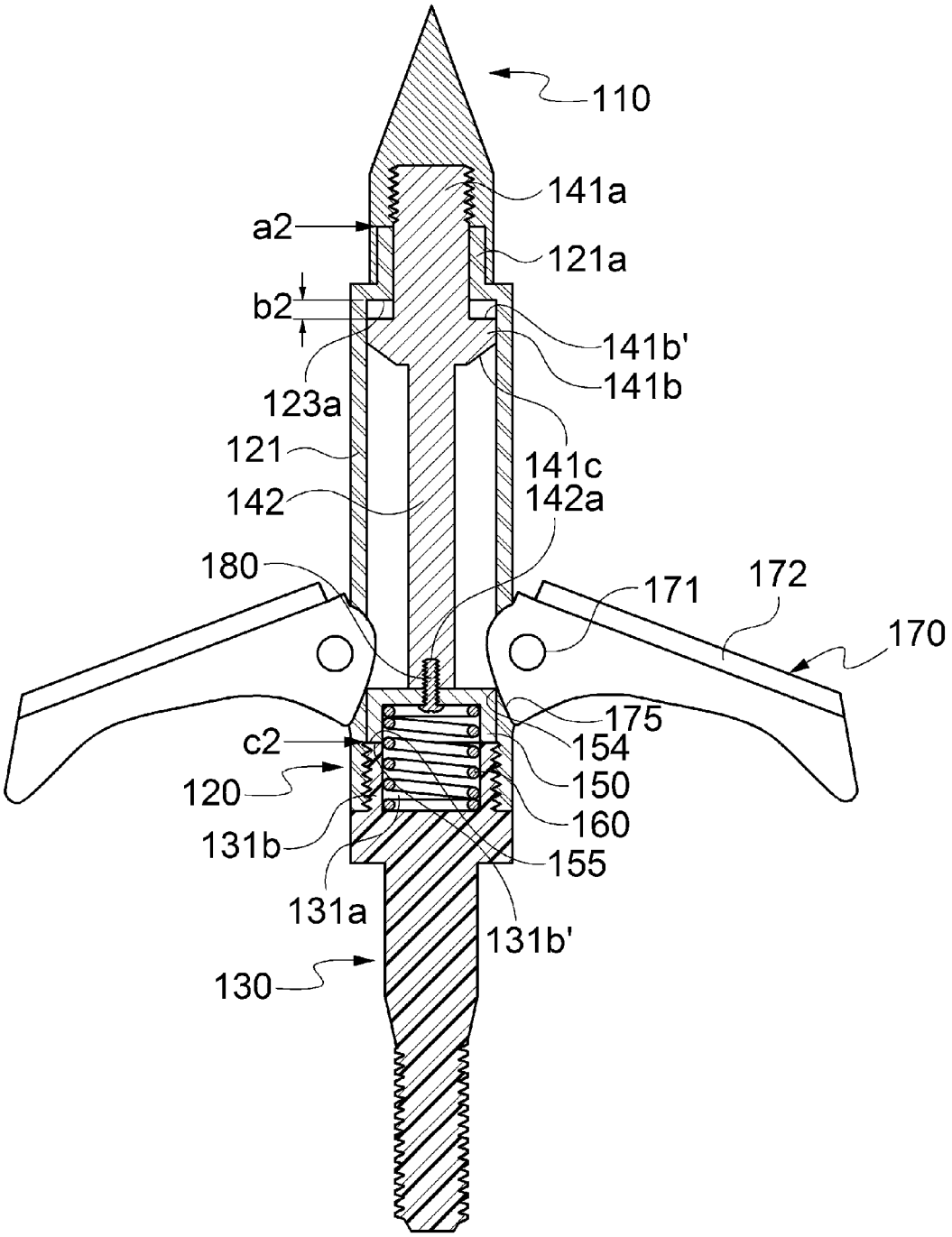
FIG. 9 is a cross-sectional view of the arrowhead when the impact delivery rod and the cylinder have moved toward a lower side of a first body as far as possible according to one embodiment of the present invention.

FIG. 9 is a cross-sectional view of the arrowhead 100 when the impact delivery rod 140 and the cylinder 150 have moved toward the lower side of the first body 120 as far as possible according to one embodiment of the present invention.

As illustrated in FIG. 9, when the impact delivery rod 140 and the cylinder 150 have moved toward the lower side of the first body 120 as far as possible, a distance a2 of the hollow portion 112*a* in the penetration tip 110 and a distance c2 between the lower surface 155 of the cylinder 150 and the upper surface 131*a* of the second body 130 may be minimized, and a distance b2 between the inner upper surface 123*a* of the hollow portion 123 of the first body 120 and the upper surface 141*b*' of the restriction member 141*b* of the impact delivery rod 140 may be maximized. The elastic member 160 may be in a maximally compressed state. Even when the cylinder 150 has moved toward the lower side of the first body 120 as far as possible, the spur 175 formed at each of the expanding blades 170 is caught by the edge 154 of the cylinder 150, and the expanding blades 170 may be prevented from excessively rotating and being bent toward the second body 130.

Figure 10:
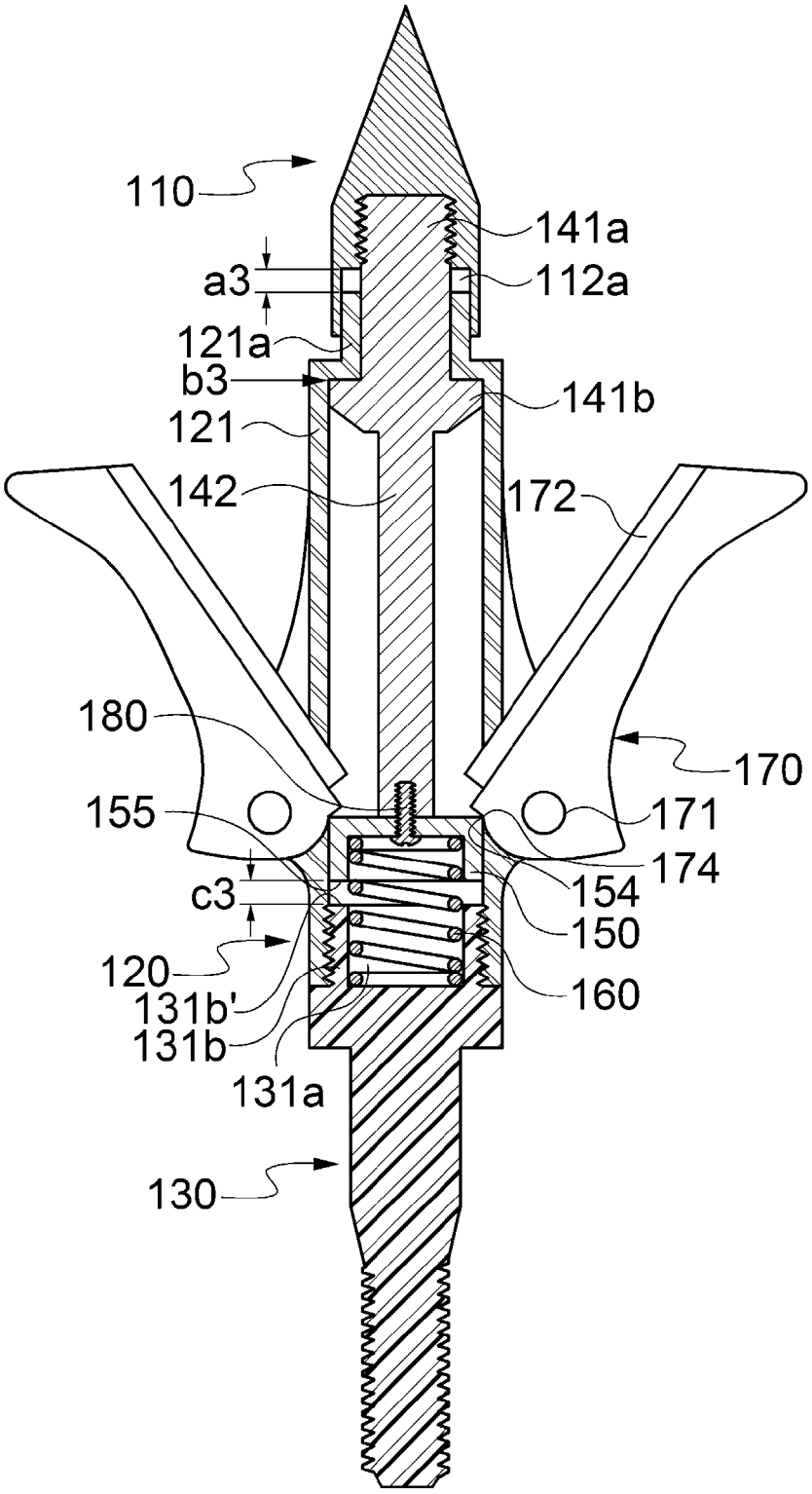
FIG. 10 is a cross-sectional view of the arrowhead when the arrowhead deeply penetrates the target according to one embodiment of the present invention.

FIG. 10 is a cross-sectional view of the arrowhead 100 when the arrowhead 100 deeply penetrates the target according to one embodiment of the present invention.

As illustrated in FIG. 10, once the arrowhead 100 has deeply penetrated the target, the impact is no longer applied to the penetration tip 110, and thus the penetration tip 110, the impact delivery rod 140 and the cylinder 150 may return to their original states due to elastic force of the elastic member 160. At this time, a distance a3 of the hollow portion 112*a* in the penetration tip 110 and a distance c3 between the lower surface 155 of the cylinder 150 and the upper surface 131*a* of the second body 130 may be maximized, and a distance b3 between the inner upper surface 123*a* of the hollow portion 123 of the first body 120 and the upper surface 141*b*' of the restriction member 141*b* of the impact delivery rod 140 may be minimized. In this case, a force in the direction in which the expanding blades 170 fold may be applied by an external factor such as movement of the target. The return restriction portions 174 formed at the expanding blades 170 are caught by the edge 154 of the cylinder 150, and the expanding blades 170 may be prevented from completely folding into the first body 120.

According to the embodiments of the present invention, the arrowhead and the arrow having the plurality of expanding blades which may fold and unfold as needed are provided. Herein, it is possible to provide the arrowhead in which, through a simple structure, the expanding blades can be maintained in the folded state during flight of the arrow, and then accurately and rapidly unfold only when the arrow hits the target.

Also, according to the embodiments of the present invention, the expanding blades are configured to unfold upon entering the target at the same time at which the arrowhead hits the target, and thus the arrow may penetrate the target in the state in which the expanding blades are unfolded. Therefore, the contacting surface between the expanding blades and the target is increased, and thus it is possible to induce excessive bleeding in the target and thus quickly subdue the target.

Also, according to the embodiments of the present invention, the expanding blades are prevented from folding again while inside the target after the arrowhead penetrates the target, and thus the excessive bleeding in the target can be maintained continuously.

It will be apparent to those skilled in the art that various modifications can be made to the above-described exemplary embodiments of the present invention without departing from the spirit or scope of the invention. Thus, it is intended that the present invention cover all such modifications provided they come within the scope of the appended claims and their equivalents.

What is claimed is:

1. An arrowhead comprising:

a penetration tip having a sharpened upper end;

a first body comprising a body portion having a hollow portion therein and one or more expanding blade guide grooves formed in an outer surface of the body portion;

an impact delivery rod connected with the penetration tip to be movable in a lengthwise direction of the first body in the hollow portion by an impact applied to the penetration tip;

a cylinder being interlocked with the impact delivery rod and movable in the lengthwise direction of the first body in the hollow portion;

an expanding blade rotatably disposed in the expanding blade guide groove to expand from the first body due to the impact delivered from the impact delivery rod; and a second body coupled with the first body and having a screw portion coupled with an arrow shaft, wherein the impact delivery rod comprises a contact surface configured to deliver the impact to the expanding blade, and the expanding blade has a groove portion capable of being coupled with an edge of the cylinder.

2. The arrowhead of claim 1, wherein a blade is formed at one side of the expanding blade, and the groove portion is formed at a lower end of the blade.

3. The arrowhead of claim 2, wherein a spur configured to prevent the expanding blade from rotating above a predetermined angle is formed at the other side of the expanding blade.

4. The arrowhead of claim 3, further comprising a return restriction portion provided between the spur and the groove portion of the expanding blade to prevent the expanding blade from returning into the first body after the expanding blade expands.

5. The arrowhead of claim 1, further comprising an elastic member disposed between the cylinder and the second body to elastically support the cylinder.

6. The arrowhead of claim 1, wherein a groove configured to accommodate the elastic member therein is formed in a lower side of the cylinder.

7. The arrowhead of claim 1, wherein a protruding portion inserted into the penetration tip is formed at an upper end of the first body, and the protruding portion is slidable in the penetration tip.

8. The arrowhead of claim 1, wherein the contact surface is located on a lower side of a restriction member, the restriction member restricting movement of the impact delivery rod in the hollow portion.

9. The arrowhead of claim 1, wherein a coupling hole is formed in the expanding blade, a rotating shaft is inserted into the coupling hole, and the expanding blade is rotatable about the rotating shaft.

* * * * *